United States Patent [19]

Felthuis et al.

[11] 4,292,993

[45] Oct. 6, 1981

[54] CLOSURE PLATE FOR HOT BLAST SLIDE VALVES

[75] Inventors: Jacob Felthuis, Alkmaar; Jacobus A. Rumphorst, Uitgeest, both of Netherlands

[73] Assignees: Hoogovens Ijmuiden B.V., IJmuiden, Netherlands; Zimmermann & Jansen GmbH, Duren/Thld, Fed. Rep. of Germany; a part interest

[21] Appl. No.: 92,863

[22] Filed: Nov. 9, 1979

[30] Foreign Application Priority Data

Nov. 9, 1978 [DE] Fed. Rep. of Germany ..... 2848570

[51] Int. Cl.[3] ..... F16K 49/00; F16K 3/00

[52] U.S. Cl. ..... 137/340; 137/375; 251/368

[58] Field of Search ..... 251/356, 368, 326; 137/340, 375

[56] References Cited

U.S. PATENT DOCUMENTS

| | | | |
|---|---|---|---|
| 1,918,430 | 7/1933 | Schlotmann | 137/340 |
| 1,956,959 | 5/1934 | McDonnell | 137/340 |
| 3,266,517 | 8/1966 | Carr | 137/340 |
| 3,448,761 | 6/1969 | Feinman | 137/340 |
| 3,449,462 | 3/1970 | Berczynski | 137/340 |
| 3,614,061 | 10/1971 | Fitzpatrick | 251/368 |
| 3,662,986 | 5/1972 | Domulewicz, Sr. | 251/368 |
| 3,837,356 | 9/1974 | Selep et al. | 251/368 |
| 4,079,747 | 3/1978 | Roberts | 251/368 |

FOREIGN PATENT DOCUMENTS

| | | | |
|---|---|---|---|
| 779554 | 7/1957 | United Kingdom | 251/368 |
| 1288250 | 9/1972 | United Kingdom | 137/340 |

*Primary Examiner*—A. Michael Chambers

*Attorney, Agent, or Firm*—Allison C. Collard; Thomas M. Galgano

[57] ABSTRACT

A closure plate for hot blast slide valves of the type having a hollow ring of box-like cross section cooled by running water to whose inner circumference a body is attached by welding, which is formed by parallel plates and is likewise cooled by running water. The thickness of the body in axial direction is smaller than the axial length of the hollow ring, and the outer surfaces are coated to about the height of the front faces of the ring with refractory concrete, the coating being tied to these outer surfaces by anchoring means. The closure plate is characterized by the following features:

(a) the anchoring means are attached to the outer surfaces of the plate body and are V-shaped and extend into the refractory coating with their free flanks for at least $\frac{2}{3}$ and at the most $\frac{3}{4}$ of the coating thickness;

(b) the anchoring means are arranged in regular distances in rows and columns extending normally to each other, the extending planes being alternately parallel and transverse to the direction of the rows and columns;

(c) the distance between the centers of the anchoring means corresponds to once or twice the thickness of the refractory coating layer.

6 Claims, 3 Drawing Figures

CLOSURE PLATE FOR HOT BLAST SLIDE VALVES

The invention relates to a closure plate for hot blast slide valves. More particularly, it relates to closure plates of the type which consist of a hollow ring of box-like cross section cooled by running water, to the inner circumference of which a body is attached by welding, which body is formed by parallel plates and is likewise cooled by running water. The thickness of this plate body in axial direction is smaller than the axial length of the hollow ring, and its outer surfaces are coated to about the height of the front faces of the ring with refractory concrete, the coating being secured to these outer surfaces by anchoring means.

Closure plates of the above-mentioned type are conventionally used on hot blast furnaces having hot blast slide valves. In modern day hot blast furnace techniques, exceedingly high blast pressures ranging up to 6 bar and blast temperatures of up to 1,550° C. are used. The high hot blast consumption of large blast furnaces requires, moreover, very large orifices for blast admission in the slide valves with more than 2 m diameters. Under these conditions, the closure plates are exposed, upon closing, to forces in the magnitude of 20 MN. Forces of this magnitude are capable of curving or arching the slide valve plates in the direction of the exerted pressure. The highest central curvature of such a plate is e.g. 3–4 mm. Such a curvature is sufficient to cause cracking and splitting off of the brittle refractory coating, particularly when the pressure exerted on the plate is frequently changing.

In the known closure plates, the spike anchors provided on the outer surfaces of the plate body are capable of retaining the refractory coating on the outer surface of the plates even after cracks are formed. However, the anchors are incapable of preventing the formation of cracks. On the contrary, the spikes are frequently the starting points for the formation of cracks, particularly when the spikes are comparatively closely placed. After the first cracks have been formed, the destruction of the coating will, as well known, proceed rapidly so that by this anchoring technique, the useful life of the coating will only be insignificantly prolonged.

It is known to prevent the premature occurrence of crack formation in the coating as a consequence of arching of the plate body by providing expansion joints which will increase the flexibility. This provides a slight extension of the durability.

It is the object of the present invention to provide a considerable extension of the useful life of the closure plates of the slide valve in hot blast furnaces.

The object can be accomplished, according to the invention, by adding to the closure plates the following new features:

(a) The anchoring means attached to the outer surfaces of the plate body are V-shaped and extend into the refractory coating with their free flanks for at least $\frac{2}{3}$ and at the most $\frac{3}{4}$ of the coating thickness;

(b) The anchoring means are arranged in regular distances in rows extending normally to each other, the extending plates being alternately parallel and transverse to the direction of the rows;

(c) The distance of the centers of the anchoring means corresponds to once or twice the thickness of the refractory coating layer.

When the combination features (a) to (c) are used, there results a much more effective anchorage of the refractory coating as compared to the spike anchors with a very close or dense arrangement of the anchoring means, the surprising fact being that in spite of the close arrangement of such means, they do not form starting points for crack formation. This may be due to the fact that the anchoring effects of the several V-anchors add up, on the one hand, because of the special arrangement of their extending planes and, on the other hand, because of their dimensions and their spacing relative to the thickness of the layer of the coating, in such a manner that no distinct tension zones will result in the coating material. As a result, the tensions will be evenly distributed over the entire volume of the coating.

The bond accomplished by the V-shaped anchoring means between the refractory concrete of the coating, on the one hand, and the plates of the plate body, on the other hand, is so strong that the refractory concrete is capable of reinforcing the plate body to an extent which decreases the tendency to elastic deformation by bending through. This, in turn, makes the formation of cracks less likely. The plates of the plate body and the overlying refractory concrete are anchored and tied together at such an intensity that they form, so to speak, a particularly rigid sandwich structure. It goes without saying that in the closure plate according to the invention the coating of refractory concrete must not have any expansion joints.

The effect achieved by applying the combination features (a)–(c), which consists of an effective stiffening of the plate body, can be obtained with any somewhat stable refractory concrete. However, the rigidity of the plate body will not eliminate the crack formations caused by differing heat expansions. The problem will especially present itself when the closure plate will be exposed to very high temperatures.

An alternative proposal, which will eliminate crack formation in the refractory coating even under the last mentioned conditions, uses the above defined features (a)–(c) and combines them with a further feature:

(d) the refractory concrete has up to 1,200° C. a heat expansion of less than 0.6%, at 20° C., a heat conductivity of more than 1.6 kcal/m h °C., and at 1000° C. of more than 1 kcal/m h °C., and consists especially of 15 to 20% of cement rich in alumina and poor in iron, as well as 80–85% additives of the following composition:

$SiO_2$=33–38%
$Al_2O_3+TiO_2$=60–65%
$Fe_2O_3$=1–2%
CaO+MgO=less than 0.1%
Al+K=less than 0.1%

The combination features (a)–(c) and their effect has already been described. The additional feature (d) provides a concrete whose heat expansion, with respect to the temperature distribution in the plate body, on the one hand, and in the coating, on the other hand, is adjusted to the heat expansion of the plate body and whose heat conductivity ensures that no great temperature gradient is generated in the coating, which, due to different heat expansions, would lead to additional tensions in the coating.

Such properties are particularly found in the concrete having the above composition; such concrete forming this being especially advantageous, in that it has a dense ceramic structure in the areas near the surface, which excellently resists chemical attack, especially by oxidizing agents. This layer with the ceramic structure, which is naturally very brittle does, however, not reach up to the top points of the anchoring means, which might cause cracks in the brittle layer.

The combination of features (a) to (d) leads to extraordinarily long life of the refractory coating, because it is neither damaged by arching of the plate body nor by differing heat expansions.

The opening angle of the flanks of the V-shaped anchors lies preferably between 45° and 65°. It has been found that with such an angle the holding power of the anchors on the refractory materials is especially advantageous. For further improvement the flanks of the anchors can be corrugated.

In yet another embodiment of the invention, the plate body is reinforced by sheet metal guides subdividing the hollow space. The guides are welded into the plates and form a double helix extending from the exterior into the interior in multiple windings. Such an arrangement of the sheet guides does not only cause a uniform cooling of the plate body, but also an even reinforcement of the plate body so that upon deformation of the body no preferred bend planes will be obtained. This arrangement of the sheet metal guides also insures that no marked tension zones will occur in the coating.

Preferably, the guide sheets are welded to the plates over their entire length by means of cross-sectionally V-shaped welding seams which are of larger cross section toward the outside. With this type of fixation of the guides to the plates of the plate body, an especially stable structure of the plate body is achieved with a box-like cross section. This structure counteracts deformations of the plate body and therewith also prevents exposure of the coating material to high bending tensions.

Other objects and features of the present invention will become apparent from the following detailed description, considered in connection with the accompanying drawings, which disclose a single embodiment of the invention. It is to be understood, however, that the drawings is designed for the purpose of illustration only, and not as a definition of the limits of the invention.

In the drawings, wherein similar reference characters denote similar elements throughout the several views.

Figure 2:
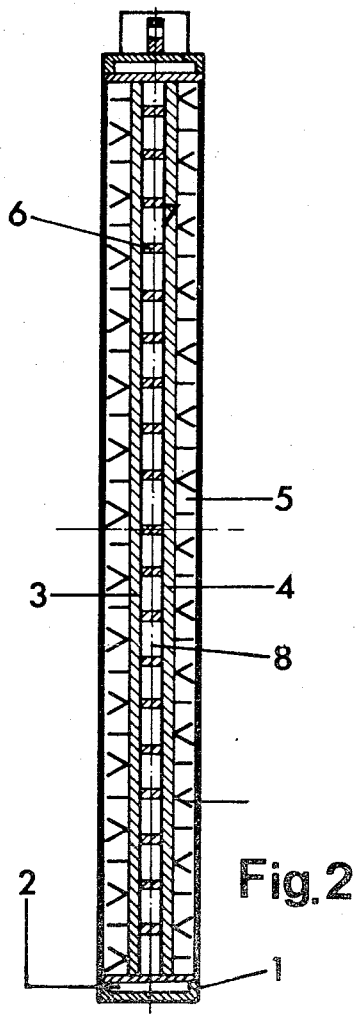
FIG. 2 is a sectional view taken along line A-B of FIG. 1.
Figure 1:
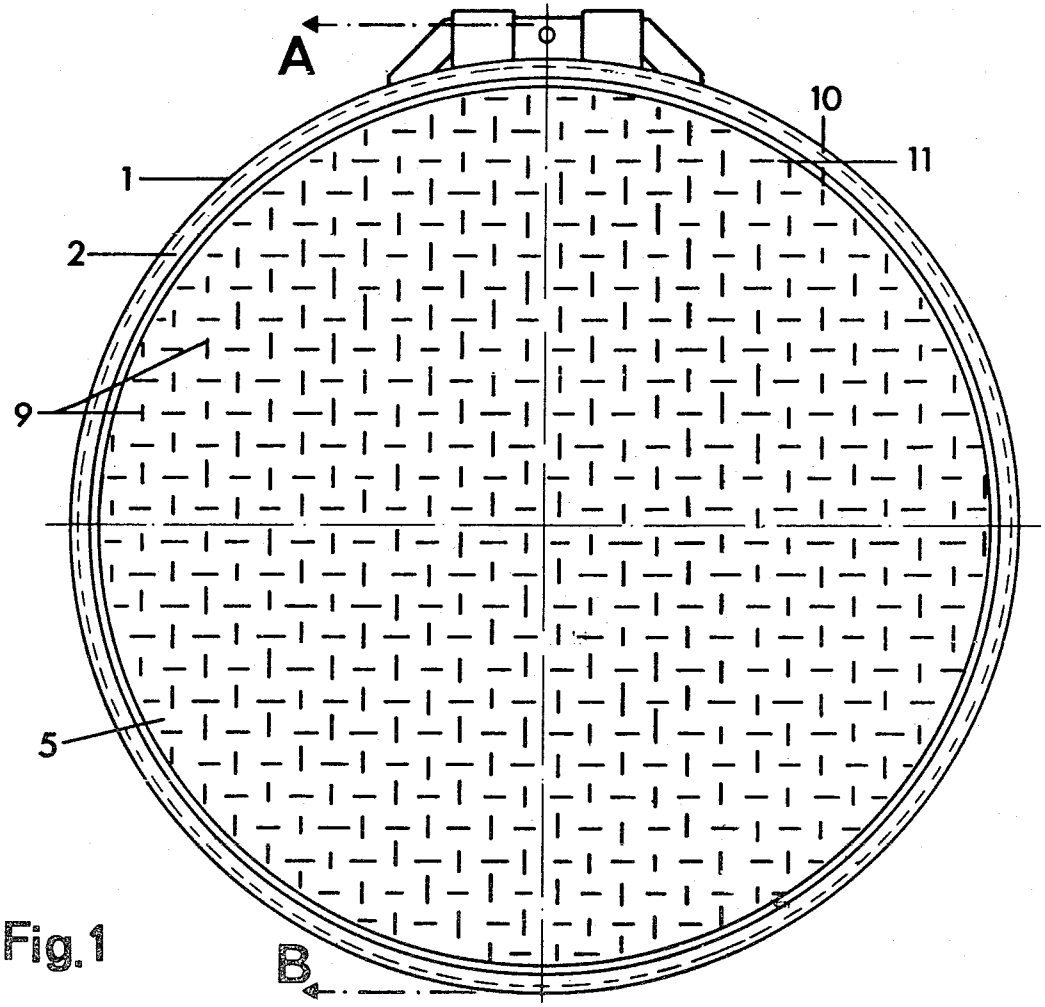
FIG. 1 is a front view of the closure plate according to the invention.

Referring now to FIGS. 1 and 2 of the drawings, a hollow ring 1 with a box-like cross section is provided which forms the outer circumference of a closure plate; the hollow space being designated by 2.

Figure 3:
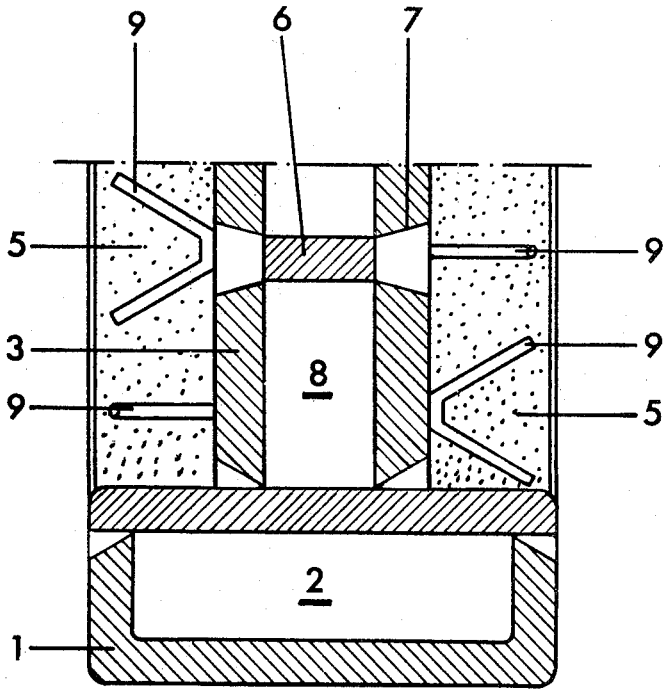
FIG. 3 is an enlarged, sectional view through the margin area of the closure plate shown in FIGS. 1 and 2.

Two circular, plane-parallel plates 3 and 4 are welded to the inner circumference of hollow ring 1. The thickness of the plate body formed by plates 3 and 4 is smaller than the axial length of the hollow ring 1, so that, in the area of both front faces of the closure plate, flat cylindrical spaces are formed for receiving a refractory charge or coating 5. This is also shown on an enlarged scale in FIG. 3.

The plates 3 and 4 are connected to one another by sheet metal guides 6 which guides are welded over their entire length to the plates by means of V-shaped welding seams 7 which have a greater thickness toward the outer side (i.e., they flare outwardly). The guide sheets 6 form a double helix extending from the exterior into the interior and create between them guide channels 8 subdividing the hollow space between plates 3 and 4. Channels 8 are in communication with the hollow space 2 of hollow ring 1 and are likewise cooled by flowing water, as is space 2.

To the outer faces of the plate body, a large number of anchors 9 are fastened, which are V-shaped in side view, and which extend into the refractory coating with their free flanks for at least $\frac{2}{3}$ and at the most $\frac{3}{4}$ of the coating thickness. The anchors 9 are arranged at regular distances in rows 10 and columns 11 extending normally to each other; the extending planes being alternately parallel and transverse to the direction of the respective row or column. The distance between the centers of anchors 9 corresponds to once or twice the thickness of the refractory coating layer 5. The opening angle of the flanks of the V-shaped anchors 9 lies between 45° and 65°. In a different modification from the illustrated example, the shanks of the anchors may be corrugated.

The refractory concrete has up to 1,200° C. a heat expansion of less than 0.6%, a heat conductivity at 20° C. of more than 1.6 kcal/m h °C., and at 1000° C. of more than 1 kcal/m h °C., and consists especially of 15 to 20% of cement rich in alumina and poor in iron, as well as 80–85% additives of the following composition:

$SiO_2$: 33–38%
$Al_2O_3+TiO_2$: 60–65%
$Fe_2O_3$: 1–2%
$CaO+MgO$: less than 0.1%
$Al+K$: less than 0.1%

The grain size of the additives of this concrete should be below 6 mm throughout.

While only a single embodiment of the present invention has been shown and described, it will be obvious that many modifications and changes may be made thereunto, without departing from the spirit and scope of the invention.

What is claimed is:

1. In a closure plate for hot blast slide valves of the type having a hollow ring of box-like cross section cooled by running water, to whose inner circumference a body is attached by welding, which is formed by parallel plates and is likewise cooled by running water, the thickness of the body in axial direction being smaller than the axial length of the hollow ring, and the outer surfaces being coated to about the height of the front faces of the ring with refractory concrete, the coating being secured to these outer surfaces by anchoring means, the improvement comprising:

(a) said anchoring means being attached to the outer surfaces of the plate body, and being V-shaped and extending into the refractory coating with their free flanks for at least $\frac{2}{3}$ and at the most $\frac{3}{4}$ of the coating thickness;

(b) said anchoring means being arranged in regular distances in rows and columns extending normally to each other, the extending planes being alternately parallel and transverse to the direction of the respective row or column; and (c) the distance between the centers of said anchoring means corresponding to at least the thickness of the refractory coating layer.

2. In a closure plate for hot blast slide valves of the type having a hollow ring of box-like cross section cooled by running water, to whose inner circumference a body is attached by welding, which is formed by parallel plates and is likewise cooled by running water, the thickness of the body in axial direction being smaller than the axial length of the hollow ring, and the outer surfaces being coated to about the height of the front faces of the ring with refractory concrete, the coating being secured to these outer surfaces by anchoring means, the improvement comprising:

(a) said anchoring means being attached to the outer surfaces of the plate body, and being V-shaped and extending into the refractory coating with their free flanks for at least $\frac{2}{3}$ and at the most $\frac{3}{4}$ of the coating thickness;

(b) said anchoring means being arranged in regular distances is rows and columns extending normally to each other, the extending planes being alternately parallel and transverse to the direction of the respective row or column;

(c) the distance between the centers of said anchoring means corresponding to at least the thickness of the refractory coating layer; and (d) said refractory concrete having up to 1,200° C. a heat expansion of less than 0.6%, at 20° C. a heat conductivity of more than 1.6 kcal/m h °C., and at 1000° C. a heat conductivity of more than 1 kcal/m h °C., and comprising 15 to 20% of cement as well as 80–85% additives of the following composition:

$SiO_2$=33–38%

$Al_2O_3+TiO_2$=60–65%

$Fe_2O_3$=1–2%

CaO+MgO=less than 0.1%

Al+K=less than 0.1%.

3. The closure plate according to claim 1 or 2, wherein the opening angle of the flanks of the V-shaped anchoring means is from 45° to 65°.

4. The closure plate according to claim 3, wherein the flanks of the anchoring means are corrugated.

5. The closure plate according to claim 1 or 2, wherein the body formed by the plates is reinforced by sheet metal guides which are welded to the plates and which form a helix with multiple windings extending from the exterior to the interior of the body.

6. The closure plate according to claim 5, wherein the sheet metal guides are welded over their entire length to the plates by means of welding seams each having a V-shaped cross section, which is larger toward the outside.

* * * * *